US005289773A

United States Patent [19]

Saito et al.

[11] Patent Number: 5,289,773

[45] Date of Patent: Mar. 1, 1994

[54] APPARATUS FOR MOUNTING PLATE ON PLATE CYLINDER

[75] Inventors: Nobuaki Saito; Masaaki Ishida, both of Ibaraki, Japan

[73] Assignee: Komori Corporation, Japan

[21] Appl. No.: 48,571

[22] Filed: Apr. 15, 1993

Related U.S. Application Data

[63] Continuation of Ser. No. 851,986, Mar. 13, 1992, abandoned.

[30] Foreign Application Priority Data

Mar. 14, 1991 [JP] Japan ..... 3-103702

[51] Int. Cl.[5] ..... B41F 27/06; B41F 27/12

[52] U.S. Cl. ..... 101/415.1; 101/382.1; 101/DIG. 36; 101/383; 101/378

[58] Field of Search ..... 101/382.1, 378, 382, 101/383, 415.1, DIG. 36, 212, 216

[56] References Cited

U.S. PATENT DOCUMENTS

| | | | |
|---|---|---|---|
| 4,191,105 | 3/1980 | Ohlsson | 101/415.1 |
| 4,363,668 | 1/1983 | Johne et al. | 101/DIG. 36 |
| 4,628,815 | 12/1986 | Van Kunegan | 101/DIG. 36 |
| 5,094,165 | 3/1992 | Sugiyama et al. | 101/378 |

FOREIGN PATENT DOCUMENTS

| | | | |
|---|---|---|---|
| 0431715 | 6/1991 | European Pat. Off. | 101/415.1 |
| 0435410 | 7/1991 | European Pat. Off. | 101/415.1 |
| 3940795 | 6/1991 | Fed. Rep. of Germany | 101/415.1 |
| 59-22755 | 2/1984 | Japan . | |
| 1-127346 | 5/1989 | Japan . | |

*Primary Examiner*—Edgar S. Burr
*Assistant Examiner*—Lynn D. Hendrickson
*Attorney, Agent, or Firm*—Blakely, Sokoloff, Taylor & Zafman

[57] ABSTRACT

An object of this invention is to provide an apparatus capable of easily and accurately mounting a plate to a predetermined position of the circumferential surface of a plate cylinder. A safety cover for covering the circumferential surface of a plate cylinder is suspended and is vertically opened/closed by a hydraulic cylinder. A plate reception member and a plate holder are mounted on the safety cover to hold a plate to be mounted on the plate cylinder. In mounting of the plate, the safety cover is opened, and the lower end of the plate is removed from the plate holder and is inserted into a plate lockup device mounted in the plate cylinder. At this time, notches formed at the lower end of the plate are respectively engaged with reference pins formed on the plate lockup device. When the upper end of the plate is inserted into the plate press member, the notches of the plate are fitted on the reference pins by the weight of the plate and the behavior of the plate press member.

8 Claims, 3 Drawing Sheets

APPARATUS FOR MOUNTING PLATE ON PLATE CYLINDER

This is a continuation of application Ser. No. 07/851,986 filed Mar. 13, 1992, now abandoned.

BACKGROUND OF THE INVENTION

The present invention relates to a plate mounting apparatus for causing a plate lockup apparatus to grip a printing plate (to be referred to as a plate hereinafter) held in the printing press near the circumferential surface of a plate cylinder in a printing press so as to mount the plate on the plate cylinder.

A gap having almost a rectangular section and a length almost equal to the overall length of a plate cylinder is formed in the circumferential surface of the plate cylinder for each of a variety of printing presses. A plate lockup apparatus consisting of a leading-side lockup device for fixing the leading end of a plate and a trailing-side lockup device for fixing the trailing end of the plate, fixed by the leading-side lockup device and then wound around the circumferential surface of the plate cylinder, is axially fixed on the bottom surface of the gap.

Each of the conventional leading- and trailing-side lockup devices comprises an elongated lockup table extending in the axial direction of the plate cylinder, a plurality of gripper plates, swingably supported at an edge portion of this lockup table, for gripping or releasing the plate with or from the lockup table by being opened or closed as they swing, and a plurality of cams which can be respectively engaged with gaps at the edges of the gripper plates. The plurality of cams are aligned along a pivotal cam shaft. A plurality of compression coil springs are interposed between the lockup table and the gripper plates to bias the gripper plates in an open direction.

With the above arrangement, in order to mount a plate on a plate cylinder, when the cam shaft is pivoted, the gripper plates which are divided in the axial direction of the plate are released from engagement with the cams and are simultaneously opened by the elastic forces of the compression coil springs. An end of the plate is inserted between the gripper plates and the corresponding lockup table. When the cam shaft is pivoted in the direction opposite to the direction described above, the gripper plates are pivoted against the elastic forces of the compression coil springs by the behavior of the cams and are closed, thereby gripping the leading end of the plate.

In an apparatus disclosed in Japanese Patent Laid-Open No. 1-127346, lockup tables and gripper plates extend along the radial direction of a plate cylinder so that trailing-side gripper surfaces which were formed in the circumferential direction of a conventional plate cylinder are formed along the radial direction of the plate cylinder. At the same time, a trailing-side end portion of the plate is bent at a right angle by a separate plate bending machine. With the above arrangement, the trailing-side end portion of the plate wound around the circumferential surface of the plate cylinder and having the leading-side end portion gripped by the leading-side lockup device is gripped such that the bent portion is inserted between the lockup table and the gripper plates of the trailing-side lockup device and is gripped while the gripper plates are swung by a cam mechanism. The trailing-side lockup device as a whole is then moved in the circumferential direction, and the plate is uniformly kept taut while being kept in contact with the circumferential surface of the plate cylinder.

In the plate mounting apparatus described above, however, it is difficult to insert the leading-side end portion of a plate into a narrow opening of the leading-side lockup device. This operation is time-consuming and requires much labor. In addition, since the plate guided to the trailing-side lockup device while being wound around the plate cylinder is not brought into tight contact with the circumferential surface of the plate cylinder, it is difficult to insert the almost right-angled trailing-side end portion of the plate into the opening of the trailing-side lockup device, thus prolonging time and increasing labor, resulting in inconvenience.

A conventional semi-automatic plate mounting apparatus is proposed. This apparatus includes a holding apparatus for holding a plate in a space between a plurality of printing units for multi-color printing, which is on the circumferential surface side of the plate cylinder. The plate is inserted into the leading-side lockup device while being held by the holding apparatus, and at the same time the plate is wound around the circumferential surface of the plate cylinder. The trailing-side end portion of the plate released from the holding apparatus is gripped by the trailing-side lockup device.

In the conventional semi-automatic plate mounting apparatus, however, U-shaped notches are formed in the leading- and trailing-side end portions of the plate, and reference pins which engage with these notches extend on the leading- and trailing-side plate devices, respectively. In order to mount a plate on the plate lockup devices, the end portions of the plate are held by hands, and the plate is inserted into the plate lockup devices. The plate lockup devices are closed while the reference pins are kept engaged with the notches, respectively. If the bottoms of the notches are separated from the reference pins upon closing of the plate lockup devices or if the bottom portions of the notches do not abut against the reference pins from the beginning, respectively, the plate mounting positions of the plate lockup devices become inaccurate. An error occurs in printing alignment, thereby degrading the quality of printed matters.

SUMMARY OF THE INVENTION

It is an object of the present invention to provide an apparatus for mounting a plate on a plate cylinder at a predetermined position with high accuracy.

It is another object of the present invention to provide an apparatus for mounting a plate on a plate cylinder wherein a time required for mounting the plate on the plate cylinder can be greatly reduced, and operation efficiency of a printing press can be improved.

It is still another object of the present invention to provide an apparatus for mounting a plate on a plate cylinder wherein precision of printed matters can be improved, and the waste of paper can be reduced.

In order to achieve the above objects of the present invention, there is provided an apparatus for mounting a plate on a plate cylinder, comprising a safety cover, having an upper end portion supported by a support member on a printing press having the plate cylinder so that the safety cover is suspended from the support member, for vertically opening/closing, and a plate holding member, mounted on the safety cover, for urging a trailing-side end portion of the plate downward when the plate is inserted into a plate fixing means of the plate cylinder.

DESCRIPTION OF THE PREFERRED EMBODIMENT

Figure 1:
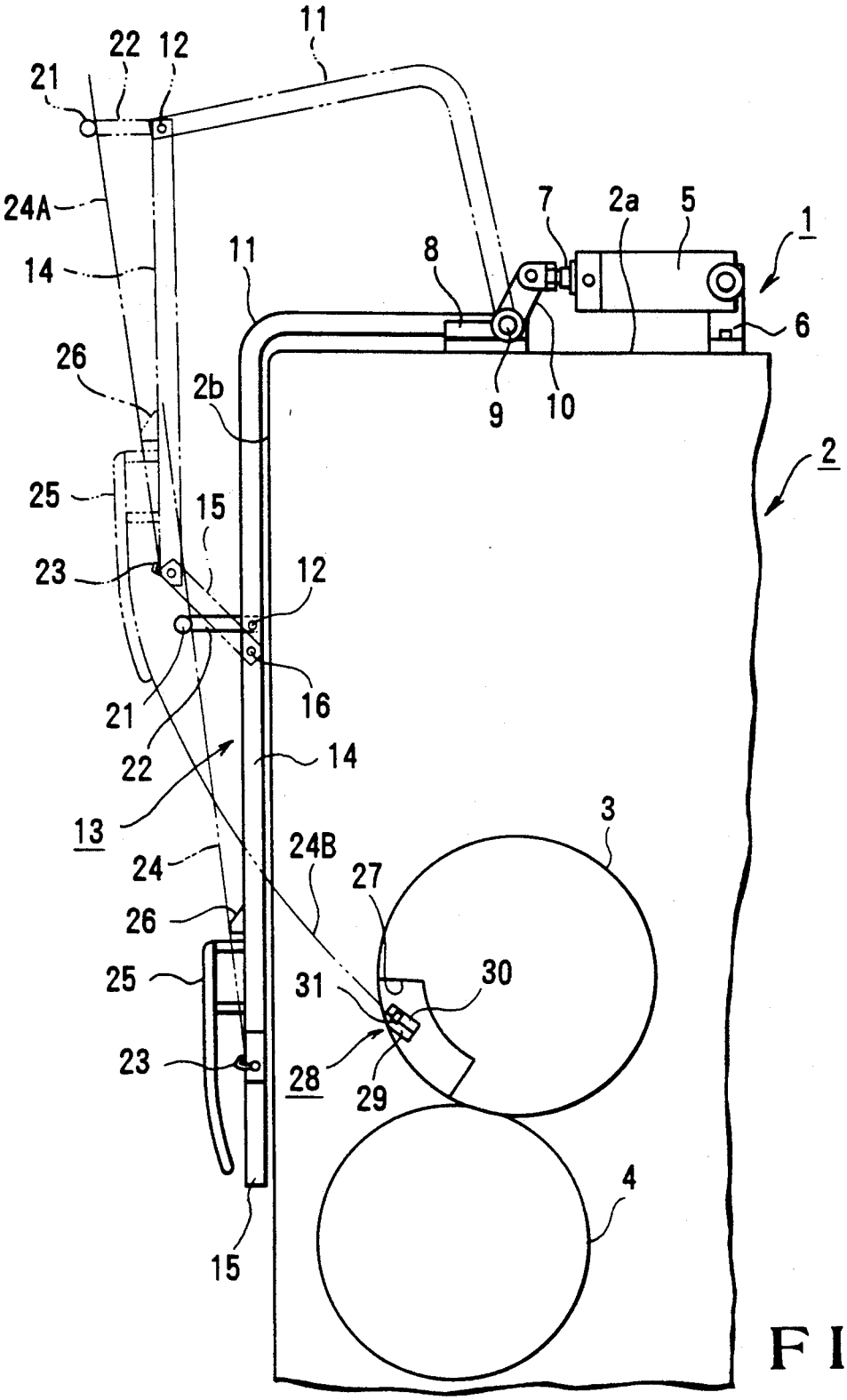
FIG. 1 is a side view of an apparatus for mounting a plate.
Figure 2:
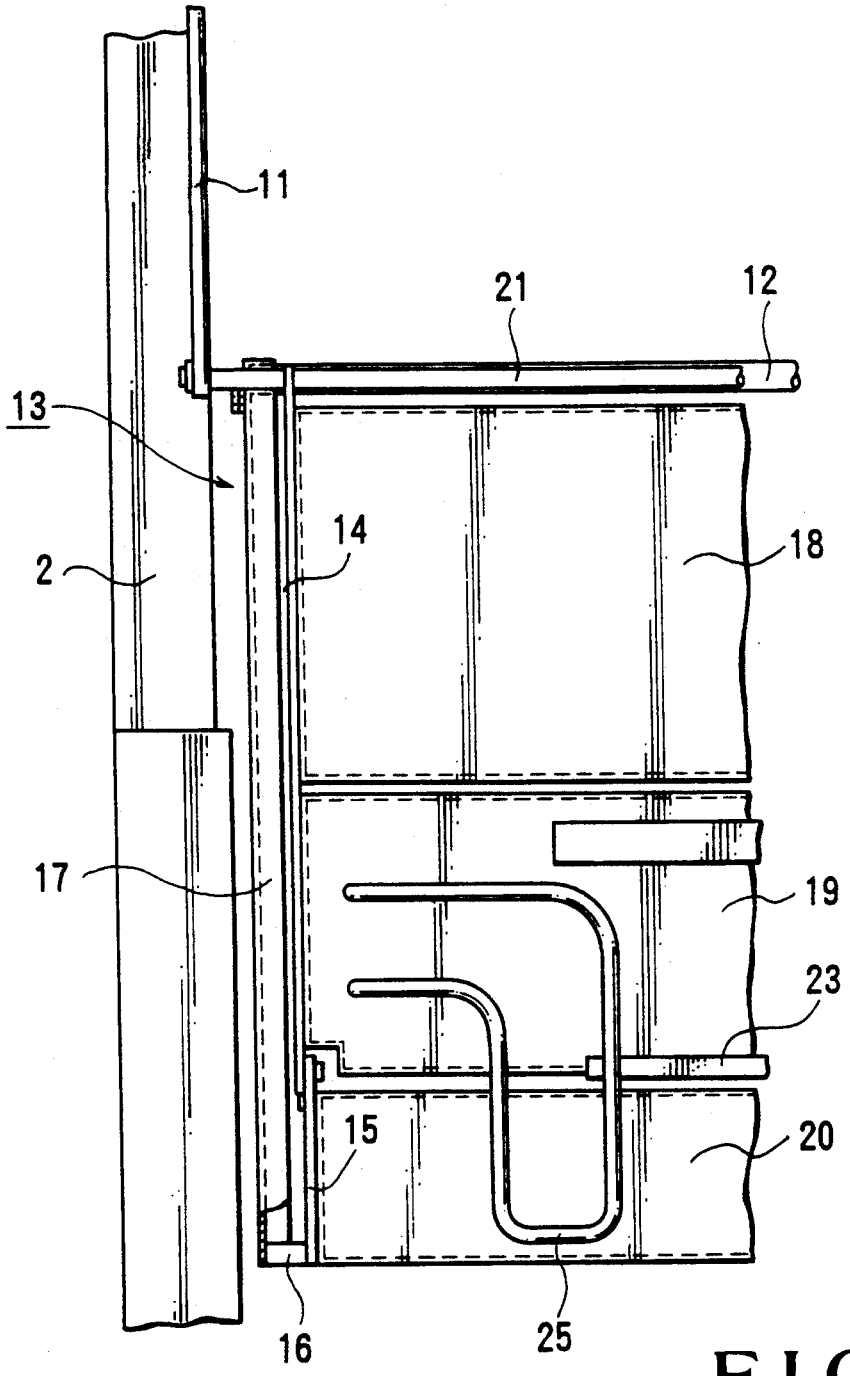
FIG. 2 is a partial front view of the apparatus for mounting a plate.

FIGS. 1 and 2 show an apparatus for mounting a plate on a plate cylinder according to an embodiment of the present invention. FIG. 1 shows the apparatus when viewed from its side, and FIG. 2 partially shows the front left portion of the apparatus. Referring to FIGS. 1 and 2, a printing unit 1 comprises a pair of right and left frames 2 to cover the side surfaces of the printing unit 1. A plate cylinder 3 and a blanket cylinder 4 are arranged in contact with each other inside the frames 2. An inking apparatus and a dampening apparatus (neither are shown) for supplying an ink and dampening water to the surface of the plate mounted on the plate cylinder 3 are arranged above the plate cylinder 3 and on the side thereof, respectively. An air cylinder 5 serving as a driving unit is pivotally supported on an upper horizontal surface 2*a* of one frame 2 through a bracket 6. A piston rod 7 of the air cylinder 5 is pivotally mounted on a lever 10 of a support shaft 9 pivotally supported on a bearing 8 on the horizontal surface 2*a*. Another bearing 8 is also arranged on the other frame 2. The support shaft 9 is bridged between the right and left frames 2.

A pair of right and left L-shaped arms 11 are fixed on the support shaft 9 mounted with the lever 10, so that the arms 11 are set in phase and have a predetermined angle with respect to the lever 10. When the piston rod 7 is reciprocated, the right and left arms 11 are pivoted through about 90° through the lever 10 and the support shaft 9, as indicated by solid lines and alternate long and two short dashed lines in FIG. 1. The arms 11 located at positions indicated by the solid lines are close to the horizontal surfaces 2*a* and vertical surfaces 2*b* of the right and left frames 2. The lower end portions of the right and left arms 11 are connected by a cover support shaft 12. Right and left vertical bars 14 constituting a safety cover 13 are pivotally supported at the two end portions of the cover support shaft 12. Bars 15 shorter than the vertical bars 14 are pivotally mounted on the lower end portions of the vertical bars 14, respectively. Pins 16 fixed at the lower end portions of the bars 15 are fitted to be vertically movable in guide bars 17 having U-shaped sections and suspended along the frames 2, respectively. Reference numerals 18, 19, and 20 denote upper, middle, and lower divided cover bodies. Both sides of the cover bodies 18 and 19 are fixed to the vertical bars 14, and both sides of the cover body 20 are fixed to the bars 15, respectively. The safety cover 13 constituted by the vertical bars 14, the bars 15 and the cover bodies 18, 19, and 20 is linear in a closed state. In an open state, however, the cover 13 is bent between the cover body 20 and the cover bodies 18 and 19 by the vertical bars 14 and the bars 15 in an L-shaped manner.

A plate reception member 21 parallel to the cover support shaft 12 at the upper end of the safety cover 13 having the structure described above is supported at its two ends by arms 22 fixed almost perpendicularly to the vertical bars 14. A plate holder 23 having an L-shaped section and slightly shorter than the safety cover 13 extends from the lower end portion of the middle cover body 19. The upper end portion of a plate 24 is supported by the plate reception member 21, and the lower end portion of the plate 24 is supported by the plate holder 23. Plate guides 25 each having an arcuated section when viewed from the side and an L shape when viewed from the front extend from the right and left end portions of the middle cover 19. The plate guides 25 are spaced apart from the cover body 19. A plate press member 26 having almost the same length as that of the plate holder 23 extends at the upper end portion of the middle body 19 and includes a downwardly open depression 26*a* for inserting trailing end of the plate 24 therein. A plate lockup table 30 and gripper plates 29 of a leading-side plate lockup device 28 are disposed inside a gap 27 formed in the circumferential surface of the plate cylinder 3. These members are schematically illustrated in FIG. 1. Reference numeral 31 denotes each reference pin for engaging with a corresponding notch formed at the lower end of the plate 24.

Figure 3:
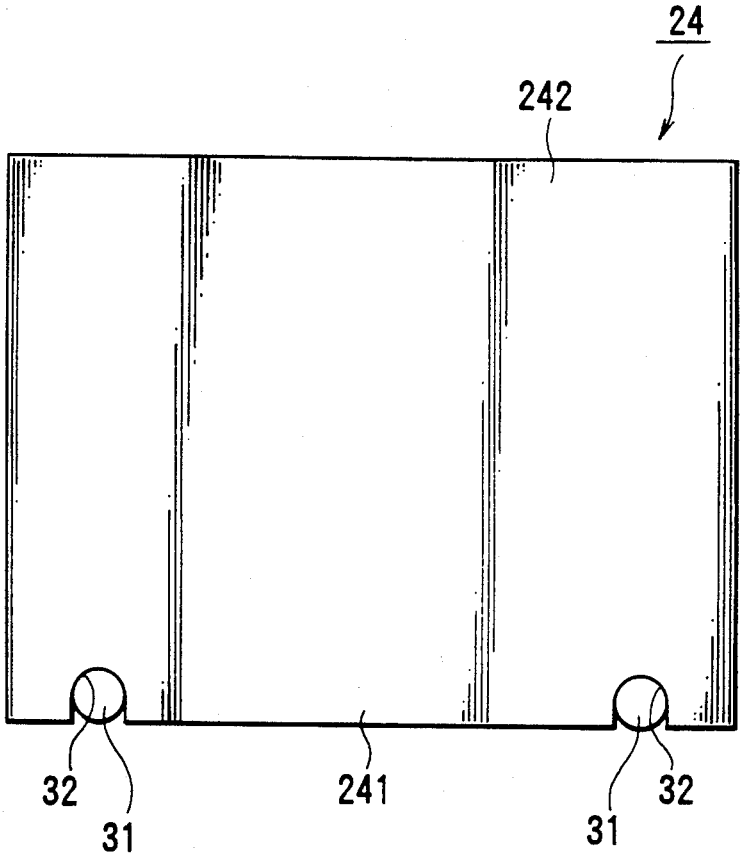
FIG. 3 is a developed plan view of a plate in a state wherein reference pins are engaged with reference notches, respectively.

FIG. 3 shows a developed state of a plate in a state wherein reference pins are fitted in reference notches, respectively. Referring to FIG. 3, two reference notches 32 are formed at a leading-side end portion 241 of the plate 24. The U-shaped reference notches 32 are open to the edges of the plate so that they are perfectly engaged with the reference pins 31, respectively.

An operation of the plate mounting apparatus having the above arrangement will be described below. During printing, the safety cover 13 is kept closed, as indicated by the solid lines in FIG. 1, thereby covering the front surface of the printing unit 1. The plate 24 is positioned by an operator such that its upper end portion is supported by the plate reception member 21, and the lower end portion of the plate 24 is supported by the plate holder 23. At this time, the plate 24 is clamped between the plate press member 26 and the plate reception member 21 without any play. When printing is completed and the plate is to be replaced with another plate, a compressed oil is supplied to the air cylinder 5 to move the piston rod 7 backward to the illustrated position. The support shaft 9 is pivoted through the lever 10, so that the right and left arms 11 supported by the support shaft 9 are pivoted to the positions indicated by the alternate long and two short dashed lines. The safety cover 13 having the vertical bars 14, the upper end portions of which are pivotally supported by the lower end portions of the arms 11, is moved to the position indicated by the alternate long and two short dashed lines while the plate is kept held as indicated by reference numeral 24A. A portion in front of the plate cylinder 3 is open. In opening of the safety cover 13, the pins 16 are linearly lifted along the longitudinal axis of the guide bars 17, so that the safety cover 13 is bent in an L shape at the position indicated by the alternate and two short dashed lines.

After the safety cover 13 is opened as described above, the unnecessary plate mounted on the plate cylinder 3 is removed from the printing press by opening/closing of the leading-side plate lockup device 28 and a trailing-side plate lockup device (not shown) and rotation of the plate cylinder 3. The plate 24 positioned in a manner as described above is gripped, and its lower end portion is removed from the plate holder 23. The plate 24 is allowed to move downward by its own weight along the inner surfaces of the plate guides 25. The plate 24 is inserted between the plate lockup table 30 and the gripper plates 29 of the leading-side plate lockup device 28 of the plate cylinder 3 stopped at the illustrated position. At this time, since the plate denoted by reference numeral 24B is curved and supported along the arcuated inner surfaces of the plate guides 25, the U-shaped reference notches 32 formed at the lower edge of the plate 24B inserted between the plate lockup table 30 and the gripper plates 29 are engaged with the corresponding reference pins 31, respectively. Since the plate 24B is received by the plate guides 25 by its own weight so that the reference notches 32 respectively abut against the bottom portions of the reference pins 31 and are engaged therewith, the plate 24B is accurately engaged with the plate lockup devices and will not be disengaged therefrom as in the conventional case wherein the plate is manually held. Thereafter, the plate 24B is flexed, and the upper edge as the trailing-side end portion of the plate 24B is inserted into the downwardly open depression 26*a* of plate press member 26 as reference numeral 24C. The plate 24C is kept abutted against the plate press member 26, the plate guides 25, and the reference pins 31. In this case, since the position of the plate press member 26 is set so that upper surface of the downwardly open depression 26*a* of the plate press member is lower than the upper end free position of the plate 24B before insertion, the plate 24C in the flexed state is properly urged against the reference pins 31. Since the positions of the plate press member 26, the plate guides 25, and the reference pins 31 relative to each other are kept unchanged, a force acting on the reference pins 31 from the plate 24C is always kept constant. Therefore, the state of the plate 24 mounted upon closing of the plate lockup devices is kept constant, and the reference pins 31 are properly engaged with the reference notches, thereby solving the problem of misalignment.

In the above embodiment, the plate press member 26 is exemplified as a plate holding member for pressing the plate downward while the upper end portion of the plate is inserted in the plate lockup device. However, the plate holding member is not limited to this. For example, a trailing-side end portion of a plate can be clamped by suction pads, rollers, or the like.

In addition, two or more plate press members 26 or plate holders 23 each may be arranged. The structures of the plate holder 23, the plate reception member 21, and the plate guides 25 are not limited to the structures exemplified in this embodiment. Any member can be used if the plate is not removed. Furthermore, if a mechanism for clamping the trailing-side end portion of the plate is employed, the above members can be omitted. The present invention is also applicable to a structure in which a safety cover is manually opened, as a matter of course.

In the apparatus for mounting a plate on a plate cylinder according to the present invention, as is apparent from the above description, since the plate holding member for holding the plate so as to urge it downward is arranged in the vertically openable safety cover, upper end portion of which is supported by a printing press member so that the safety cover is suspended from the printing press member, the recesses formed at the lower end of the plate can be accurately urged against and engaged with the reference pins of the plate lockup device by the weight of the plate and the behavior of the plate holding member. Mounting precision of the plate can be improved, and printing alignment precision can be improved accordingly. In addition, the alignment adjustment time can be almost eliminated to shorten the plate mounting time, thereby improving operation efficiency of the printing press and reducing the waste paper. The plate can be easily mounted without skills, thereby achieving energy saving.

What is claimed is:

1. An apparatus for mounting a plate on a plate cylinder of a printing press, the plate having a leading-side end portion, and a trailing-side end portion, the plate cylinder comprising a plate fixing means having a leading-side plate fixing means, said leading-side end portions having reference notches, said leading-side plate fixing means including reference pins for corresponding engagement of the reference notches of the leading-side end portion of the plate, the apparatus comprising:

a support member coupled to the printing press;

a safety cover supported from the support member to suspend the safety cover from the support member for vertical opening and closing of the safety cover; and a plate holding member mounted on the safety cover partially contacting the plate, the portion of the plate holding member that contacts the plate being lower than the trailing-side end portion of the plate when the safety cover is in an open state and when the leading-side end portion of the plate is inserted into the leading-side plate fixing means, the plate holding member having means for urging the trailing-side end portion of the plate downward when the leading-side end portion of the plate is inserted into the leading-side plate fixing means, the plate being biased so as to be bent and to urge the reference notches of the leading-side end portion of the plate against the reference pins of the leading-side plate fixing means during opening of the leading-side plate fixing means.

2. An apparatus for mounting a plate on a plate cylinder of a printing press, the plate having a leading-side end portion, reference notches and a trailing-side end portion, the plate cylinder comprising a plate fixing means having a leading-side plate fixing means, said leading-side end portions having reference notches, said leading-side plate fixing means including reference pins for corresponding engagement of the reference notches of the leading-side end portion of the plate, the apparatus comprising:

a support member coupled to the printing press;

a safety cover supported from the support member to suspend the safety cover from the support member for vertical opening and closing of the safety cover; and a plate holding member mounted on the safety cover, the plate holding member having means for urging the trailing-side end portion of the plate downward when the leading-side end portion of the plate is inserted into the leading-side plate fixing means, the plate being biased so as to urge the reference notches of the leading-side end portion of the plate against the reference pins of the leading-side plate fixing means during opening of the leading-side plate fixing means, the plate holding member further comprising a downwardly open depression for inserting the trailing-side end portion of the plate therein, the downwardly open depression having an upper surface lower than the trailing-side end portion of the plate when the safety cover is in an open state and the leading-side end portion of the plate is inserted into the leading-side plate fixing means.

3. An apparatus according to claim 1, wherein the safety cover comprises an upper portion having a plate reception member mounted outside the safety cover for supporting the trailing-side portion of the plate and a lower portion having a plate holder for holding the leading-side end portion of the plate, the plate holding member mounted on the safety cover between the plate reception member and the plate holder, and the plate holding member and the plate reception member holding a face of the plate therebetween.

4. An apparatus for mounting a plate on a plate cylinder of a printing press, the plate having a leading-side end portion, reference notches and a trailing-side end portion, the plate cylinder comprising a plate fixing means having a leading-side plate fixing means, said leading-side end portions having reference notches, said leading-side plate fixing means including reference pins for corresponding engagement of the reference notches of the leading-side end portion of the plate, the apparatus comprising:

a support member coupled to the printing press;

a safety cover supported from the support member to suspend the safety cover from the support member for vertical opening and closing of the safety cover;

a plate holding member mounted on the safety cover, the plate holding member having means for urging the trailing-side end portion of the plate downward when the leading-side end portion of the plate is inserted into the leading-side plate fixing means, the plate being biased so as to urge the reference notches of the leading-side end portion of the plate against the reference pins of the leading-side plate fixing means during opening of the leading-side plate fixing means; and a vertically arcuated plate guide positioned below the plate holding member and extending from the safety cover so as to be spaced apart therefrom, the plate guide bending the plate to urge the plate downward when the trailing-side end portion is held by said plate holding member and the leading-side end portion of the plate is inserted into the leading-side plate fixing means.

5. An apparatus according to claim 4, wherein the plate is conveyed downward along an arcuated inner surface of the plate guide during feeding of the plate to said plate cylinder, and the leading-side end portion of the plate moved downward is inserted and fixed to the plate fixing means of the plate cylinder located on a line extending from the safety cover.

6. An apparatus for mounting a plate on a plate cylinder of a printing press, the plate cylinder having a plate fixing means, the plate having a leading-side end portion and a trailing-side end portion, the apparatus comprising:

a support member coupled to the printing press;

a safety cover supported from the support member to suspend the safety cover from the support member for vertical opening and closing of the safety cover; and a plate holding member mounted on the safety cover for urging the trailing-side end portion of the plate downward when the plate is inserted into the plate fixing means of the plate cylinder, the plate holding member having a downwardly open depression for inserting the trailing-side end portion of the plate therein, the downwardly open depression having an upper surface lower than the trailing-side end portion of the plate when the safety cover is in an open state and the leading-side end portion of the plate is inserted into the leading-side plate fixing means.

7. An apparatus for mounting a plate on a plate cylinder of a printing press, the plate cylinder having a plate fixing means, the plate having a leading-side end portion and a trailing-side end portion, the apparatus comprising:

a support member coupled to the printing press;

a safety cover supported from the support member to suspend the safety cover from the support member for vertical opening and closing of the safety cover;

a plate holding member mounted on the safety cover for urging the trailing-side end portion of the plate downward when the plate is inserted into the plate fixing means of the plate cylinder; and a vertically arcuated plate guide positioned below the plate holding member and extending from the safety cover so as to be spaced apart therefrom, the plate guide bending the plate having the trailing-side end portion held by the plate holding member during mounting of the plate on the plate cylinder, so that the leading-side end portion applies a force to the plate fixing means of the plate cylinder into which the plate is inserted.

8. An apparatus according to claim 7, wherein the plate is conveyed downward along an arcuated inner surface of the plate guide during feeding of the plate to the plate cylinder, and the leading-side end portion of the plate moved downward is inserted and fixed to the plate fixing means of the plate cylinder located on a line extending from the safety cover.

* * * * *